US005824245A

United States Patent [19]

Tamaki et al.

[11] Patent Number: 5,824,245

[45] Date of Patent: Oct. 20, 1998

[54] PROCESSES FOR PREPARING MILLED GRAPHITE FIBERS

[75] Inventors: Toshio Tamaki; Minoru Tamaki; Yasushi Katsuta, all of Kamisu-machi, Japan

[73] Assignee: Petoca, Ltd., Tokyo, Japan

[21] Appl. No.: 535,747

[22] Filed: Sep. 28, 1995

[30] Foreign Application Priority Data

Sep. 29, 1994 [JP] Japan ..... 6-259013

[51] Int. Cl.[6] ..... D01F 9/155

[52] U.S. Cl. ..... 264/29.2; 264/29.6; 264/29.7; 264/234

[58] Field of Search ..... 264/29.2, 29.5, 264/234, 29.6, 29.7

[56] References Cited

U.S. PATENT DOCUMENTS

| | | | |
|---|---|---|---|
| 4,980,250 | 12/1990 | Takahashi et al. . | |
| 5,061,413 | 10/1991 | Uemura et al. . | |
| 5,244,757 | 9/1993 | Takami et al. . | |
| 5,312,611 | 5/1994 | Takami et al. . | |
| 5,340,670 | 8/1994 | Takami et al. . | |
| 5,556,723 | 9/1996 | Ohsaki et al. | 264/29.2 |

FOREIGN PATENT DOCUMENTS

| | | |
|---|---|---|
| 0 495 613 | 7/1992 | European Pat. Off. . |
| 0 644 280 | 3/1995 | European Pat. Off. . |
| 0 644 603 | 3/1995 | European Pat. Off. . |
| 4 61747 | 2/1992 | Japan . |
| 5247729 | 9/1993 | Japan . |
| 5 325967 | 12/1993 | Japan . |
| 6 168725 | 6/1994 | Japan . |

OTHER PUBLICATIONS

Patent Abstracts of Japan, vol. 18, No. 12 (C–1150), Jan. 11, 1994, JP–247729, Sep. 24, 1993.

Proceedings of the Symposium on High Power, Ambient Temperature Lithium Batteries, vol. 92, No. 15, Oct. 13, 1991, pp. 80–89, N. Imanishi, et al., "The Structure and Charge–Discharge Characteristics of Mesophase–Pitch Based Carbons".

Journal of the Electrochemical Society, vol. 140, No. 2. pp. 315–320, Feb., 1993, N. Imanishi, et al., "Charge–Discharge Characteristics of Mesophase–Pitch–Based Carbon Fibers for Lithium Cells".

Patent Abstracts of Japan, JP–A–5 247729, Sep. 24, 1993.

*Primary Examiner*—James Derrington

*Attorney, Agent, or Firm*—Oblon, Spivak, McClelland, Maier & Neustadt, P.C.

[57] ABSTRACT

Disclosed is a process for preparing milled graphite fibers in which the amount of metallic components contained in the milled carbon fibers before graphitizing is limited to not more than 100/1,000,000 in terms of a ratio by weight. Also disclosed is a process for preparing milled graphite fibers in which the amount of metallic components contained in the milled carbon fibers before graphitizing except metallic components originally contained in the fibers themselves is limited to not more than 50/1,000,000 in terms of a ratio by weight. According to these processes, there can be obtained milled graphite fibers whose surfaces are inert, which suffer few longitudinal crackings and which are almost free from occurrence of particulate substances comprising agglomerated or bonded fibers.

1 Claim, 1 Drawing Sheet

PROCESSES FOR PREPARING MILLED GRAPHITE FIBERS

FIELD OF THE INVENTION

The present invention relates to improvements in the processes for preparing milled graphite fibers. More particularly, the invention relates to processes for preparing milled graphite fibers by which agglomeration or bonding of milled fibers brought about in the high-temperature graphitizing of the milled carbon fibers is restrained to improve the yield of product.

BACKGROUND OF THE INVENTION

For preparing milled graphite fibers from carbon fibers, generally employed is a process comprising the steps of initially graphitizing the carbon fibers and then milling the fibers. This process does not come into question when the milled graphite fibers obtained by this process are applied to uses where uniformity of the fiber shapes or inertness of the surface functional group is not particularly strictly taken into consideration, e.g., use for imparting conductivity to resins or use as additives to cement. However, this process comes into question in use where the functional group such as hydroxyl group should not be present on the fiber surface, the fiber shapes dominate properties of the product, or foreign matters such as agglomerates must not be present.

That is, when the graphite fibers are milled in the above process, the rupture cross-sections of the fibers become active sites, whereby functional groups such as hydroxyl group are easily produced. Further, when the graphite fibers are milled, their graphite layers are broken to cause longitudinal crackings, whereby the shapes of the fibers are altered. Moreover, the graphite fibers are difficult to be milled because of high hardness.

In order to cope with those problems, Japanese Patent Laid-Open Publication No. 247729/1993 proposes a process for preparing milled graphite fibers of extremely short length, which comprises the steps of milling infusibilized fibers or fibers obtained by heat-treating the infusibilized fibers at a temperature of not higher than 600° C. by means of a press to obtain milled fibers of extremely short length and graphitizing them. In the process using the infusibilized fibers or the fibers obtained by heat-treating the infusibilized fibers at a temperature of not higher than 600° C. as objects to be milled as described above, the fibers can be easily milled by means of a press or the like, because they are per se brittle. In this process, however, the fibers are milled until they lose their original shapes, and hence this process is not suitable for preparing milled graphite fibers of relatively long fiber length.

Further, the fibers obtained by heat-treating the infusibilized fibers at a temperature of not higher than 600° C. are low in the density and the milled fibers have a bulk density of about 0.6 g/cm$^3$. Therefore, this process has a disadvantage that efficiency of filling a graphitization container such as a crucible with the milled fibers is bad and the cost of graphitizing becomes high. Furthermore, there also resides other problem that oxygens remaining in the fibers serve to disorder the graphite structure in the graphitizing procedure thereby to lower a degree of graphitization of the fibers.

There is also known a process for preparing milled graphite fibers, comprising the steps of heat-treating fibers at a temperature of not lower than 600° C. and at which graphitization does not proceed (usually not higher than 2,000° C.) to prepare carbon fibers, milling the carbon fibers to give milled carbon fibers and then graphitizing the milled carbon fibers. In this process, since milling of the fibers is not conducted after the graphitization, production of the surface hydroxyl group can be almost completely inhibited. Further, the carbon fibers are milled while no graphite layers are not so developed, and therefore longitudinal crackings hardly take place in the milling procedure. Furthermore, the bulk density of the milled fibers can be raised, whereby the efficiency in the graphitization procedure can be improved.

By the way, the hardness of the carbon fibers steeply increases when they are heat-treated particularly at a temperature of not lower than 800° C. In the above process, therefore, a blade of a milling machine is easily abraded in the milling procedure. If the blade is abraded, the particle size of the milled fibers varies. Consequently, the above process comes into question in obtaining milled fibers of long-term stable properties. In addition, it has been clarified that high-temperature graphitizing of the carbon fibers prepared as above causes production of particulate substances comprising agglomerated or bonded fibers. Such particulate substances deteriorate quality of the product, and hence an additional step for removing the particulate substances is required. Moreover, the yield of product is lowered and the production cost is increased.

The present inventors have earnestly studied a process for preparing milled graphite fibers comprising the steps of milling carbon fibers and high-temperature graphitizing the milled carbon fibers, and they have found the followings.

That is, the present inventors have found that the particulate substances consist of milled fibers and spherical matters of various sizes which are presumably produced during the high-temperature graphitizing as shown in FIGS. 1 and 2, and it has been ascertained that the fibers are bonded to each other by the spherical matters. Moreover, it has been clarified by secondary ion mass spectrometry that the spherical matters are made up of metallic center cores and carbons surrounding the cores.

The sources of the carbons for forming the spherical matters are plentifully present when the milled fibers are subjected to the high-temperature graphitizing, and it is difficult to remove them. Therefore, the present inventors considered that if the metallic cores constituting the spherical matters were removed, production of the particulate substances comprising agglomerated or bonded fibers could be inhibited, and they have made researches on causes of contamination with the metallic components and means for removing the metallic components.

As a result, the present inventors have found that the metallic components except metallic components originally contained in the fibers are mostly produced by metal abrasion in the milling procedure, and they have succeeded in conspicuously reducing the amount of the particulate substances comprising agglomerated or bonded milled fibers by limiting the amount of the metallic components contained in the milled carbon fibers before the high-temperature graphitizing to not more than 100/1,000,000 in terms of a ratio by weight.

OBJECT OF THE INVENTION

It is an object of the invention to provide a process for preparing milled graphite fibers by which milled graphite fibers having inert surfaces, suffering few longitudinal crackings and almost free from occurrence of particulate substances comprising agglomerated or bonded fibers can be obtained.

THE SUMMARY OF THE INVENTION

There is provided by the invention a process for preparing milled graphite fibers, comprising the steps of milling carbon fibers and high-temperature graphitizing the milled carbon fibers to prepare milled graphite fibers, in which the amount of metallic components contained in the milled carbon fibers before the graphitizing is limited to not more than 100/1,000,000 in terms of a ratio by weight.

There is also provided by the invention a process for preparing milled graphite fibers, comprising the steps of milling carbon fibers and high-temperature graphitizing the milled carbon fibers to prepare milled graphite fibers, in which the amount of metallic components contained in the milled carbon fibers before the graphitizing except metallic components originally contained in the fibers themselves is limited to not more than 50/1,000,000 in terms of a ratio by weight.

In the present invention, fibers obtained by heat-treating infusibilized fibers at a temperature of not higher than 2,000° C. (carbonization) and not subjected to graphitization are referred to as "carbon fibers", and fibers obtained by heat-treating the carbon fibers or the infusibilized fibers at a temperature of not lower than 2,000° C. (high-temperature graphitizing) to have a graphite structure are referred to as "graphite fibers".

In the present invention, the amounts of five kinds of metallic elements, i.e., Fe, Ni, V, Si and Al, contained in the fibers are measured, and the total amount thereof is defined as the amount of the metallic components.

The measurement of the amount of each metallic element is carried out by plasma emission analysis.

DETAILED DESCRIPTION OF THE INVENTION

Figure 1:
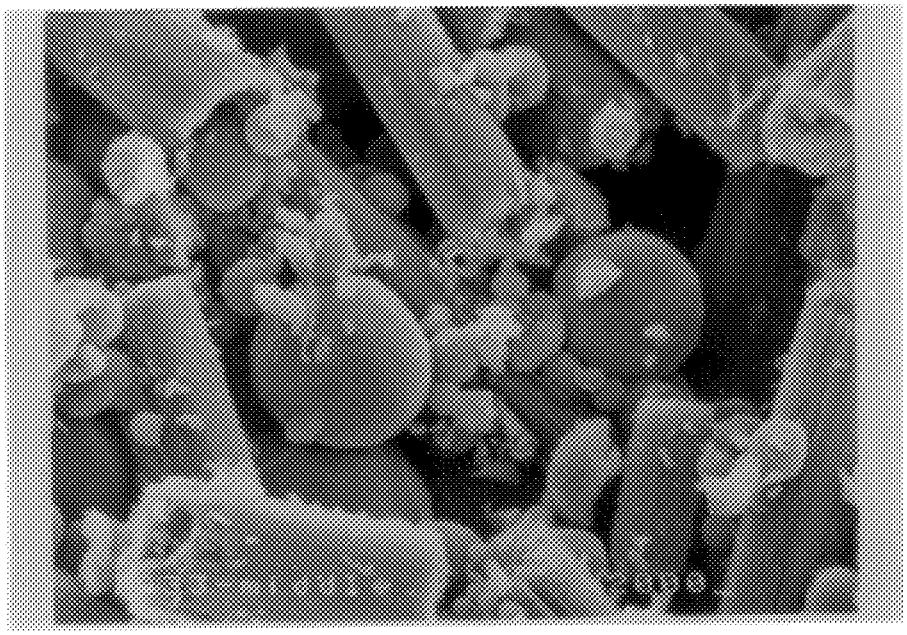
FIG. 1 is a 2,000-magnification scanning electron micrograph of particulate substances separated by sifting milled graphite fibers obtained in Comparative Example 1.

The present invention will be described in detail hereinafter.

The present invention is intended to improve a process for preparing milled graphite fibers, and various processes for preparing milled graphite fibers satisfying the following requisites are included in the embodiments of the invention.

1. Easily-graphitizable pitch type carbon fibers are used as starting materials.
2. The carbon fibers are graphitized at a high temperature of not lower than 2,500° C.
3. Most of the milled graphite fibers are in the column-like shapes obtained by cutting the fibers into pieces in the fiber cross-sectional direction.
4. The milled graphite fibers do not substantially contain particulate substances comprising agglomerated or bonded milled fibers.
5. The milled graphite fibers do not substantially have functional groups on their surfaces.

The milled graphite fibers desirably have (a) a small surface area, i.e., a BET specific surface area of 0.1 to 10 $m^2/g$, preferably 0.4 to 4 $m^2/g$, and/or (b) a small aspect ratio (ratio of fiber length to fiber diameter), i.e., an aspect ratio of 1 to 20, preferably 2 to 10, and/or (c) a relatively small variation in the fiber diameter, i.e., a fiber diameter variation coefficient of 5 to 50%, preferably 10 to 30%.

The milled fibers (milled graphite fibers, milled carbon fibers, etc.) are those having a fiber length of usually not longer than 1 mm, e.g., not longer than 150 $\mu$m, preferably about 10 to 100 $\mu$m.

The milled graphite fibers of such properties have advantages that the strength is hardly lowered when they are used for reinforcing metals as in fiber-reinforced metal composites (MMC) and no cycle deterioration is brought about when they are used as electrodes such as negative electrode for secondary battery.

Such milled graphite fibers as mentioned above can be employed as fiber reinforcements for MMC or as electrode sheet materials for secondary battery.

If particulate substances comprising agglomerated or bonded milled fibers is contained in the milled graphite fibers used as the fiber reinforcements for MMC, a metal as a matrix does not uniformly permeate into the milled graphite fiber particles, resulting in forming of pores. Such pores cause marked lowering of the strength of the resulting MMC.

In the use as electrodes for secondary battery, a base film for forming a collector, such as a copper foil or an aluminum foil, is coated with a mixture of the milled graphite fibers and a binder. In this case, however, if particulate substances comprising agglomerated or bonded milled fibers are present, the particulate substances flaw the base film in the combining procedure, resulting in defective products. Therefore, the particulate substances must be removed to 1% or less.

In the process of the invention, carbon fibers are initially milled by a milling machine and then subjected to high-temperature graphitizing in a graphitization furnace (graphitization treatment), to prepare milled graphite fibers.

The carbon fibers are preferably those obtained from easily-graphitizable pitch, because fibers having relatively long and stable fiber length can be obtained.

The easily-graphitizable pitch is, for example, optically anisotropic pitch such as mesophase pitch, which is obtained from petroleum or coal as a raw material.

Examples of the milling machines preferably used in the invention include a victory mill, a jet mill and a cross-flow mill.

Specifically, a machine provided with a high-speed rotor equipped with a blade, e.g., a cross-flow mill, is most preferred. In the use of the machine, the fiber length of the milled graphite fibers can be controlled by adjusting the rotation number of the rotor, angle of the blade, mesh size of a filter provided around the rotor, etc.

In the milling step of the carbon fibers, an attrition mill as a Henschel mixer or a ball mill may be employable, but use of such machine is unfavorable because a pressure is applied in the direction of fiber diameter to frequently cause longitudinal cracking of the fibers in the direction of fiber axis. In addition, use of such machine requires a long period of time for milling.

The temperature for carbonizing the fibers is in the range of usually 500° to 1,300° C., preferably 600° to 1,200° C., more preferably 600° to 700° C.

The carbon fibers obtained by carbonization at a temperature of not higher than 500° C. are unfavorable, because they are sometimes milled so violently that their original shapes are hardly kept, depending upon the type of the milling machine used. The carbon fibers obtained by carbonization at a temperature of not lower than 1,300° C. are also unfavorable, because they are cracked in the longitudinal direction of the fibers in a greater or less degree depending upon the type of the milling machine used.

When the easily-graphitizable pitch is used as a raw material of the fibers, the carbonization temperature is preferably in the range of 600° to 1,200° C. because a relatively long and stable fiber length can be obtained.

From the viewpoints of properties of the milled graphite fibers, a material of higher hardness (e.g., nitriding-treated metal) is preferably used for a blade or an attrition part of the attrition machine, but in this case the material cost generally tends to be increased. Therefore, the milling machine and the material thereof are selected in consideration of the hardness of the carbon fibers to be milled and the economical effects.

As the carbonization temperature is raised, the hardness of the carbon fibers tends to steeply increase, and hence in order to economically select the milling machine and the material thereof, the temperature for carbonizing the fibers is preferably not higher than 700° C. The carbon fibers obtained by carbonization at a temperature of higher than 700° C. have too high hardness, and this causes abrupt increase of metal abrasion in the milling machine made of an ordinary material, though it depends on the type of the milling machine and the material thereof. As a result, the amount of the metallic components contained in the milled carbon fibers becomes more than 100/1,000,000.

In the case of such a milling machine that milling of the carbon fibers is performed by mechanical collision of a milling part of the machine with the carbon fibers, the metal abrasion easily takes place, and therefore the milling part of the milling machine should be made of a material that is hardly abraded. For example, the milling part is made of preferably a nitriding-treated metal, which is hardly abraded.

Also in the case of such a milling machine that milling is mainly performed by other means than the mechanical collision (e.g., jet mill), the metallic portion of the milling machine is preferably reinforced by inner lining or coating with a high-hardness metal such as titanium in order to avoid abrasion or breaking of the milling machine or contamination with oxide of a metal or the like which constitutes the milling part of the milling machine.

It is also important to improve the working atmosphere so that contamination with the metallic components are reduced to the utmost extent in the milling procedure and contamination with metallic oxide or the like is inhibited also in the subsequent procedure.

By preventing the milling machine from abrasion, separation or breaking of its metallic portion as described above, the particulate substances comprising agglomerated or bonded milled fibers can be reduced in the milled fibers obtained by the graphitization treatment. Moreover, because of no blade abrasion in the milling procedure for the carbon fibers, milled graphite fibers having a stable particle size distribution can be prepared during a long term.

The milled carbon fibers are then subjected to high-temperature graphitizing using, for example, a batch type graphitization furnace, to prepare milled graphite fibers. The temperature for the high-temperature graphitizing is preferably not lower than 2,500° C. from the viewpoints of increasing the degree of graphitization and reducing the functional groups.

According to the process of the present invention comprising the steps of milling carbon fibers and high-temperature graphitizing the milled carbon fibers to prepare milled graphite fibers, the amount of the metallic components contained in the milled carbon fibers can be limited to not more than 100/1,000,000 in terms of a ratio by weight, whereby production of spherical matters having metallic center cores can be restrained. Moreover, occurrence of particulate substances comprising the agglomerated or bonded milled fibers, that is caused by the production of the spherical matters, can be also restrained. As a result, technique for preparing milled graphite fibers of stable qualities in a high yield can be established by the present invention.

The carbon fibers generally contain metallic components in an amount of 10/1,000,000 to 50/1,000,000 in terms of a ratio by weight, although the amount thereof varies depending on the material for forming the fibers and the method of treating the material. This is the reason why the amount of the metallic components introduced from the outside is limited to not more than 50/1,000,000 in terms of a ratio by weight.

EFFECT OF THE INVENTION

According to the processes of the invention, as described above, there can be obtained milled graphite fibers whose surfaces are inert, which suffer few longitudinal crackings and which are almost free from occurrence of particulate substances comprising agglomerated or bonded fibers.

EXAMPLE

The present invention will be further described with reference to the following examples, but it should be construed that the invention is in no way limited to those examples.

Example 1

Petroleum-based optically anisotropic mesophase pitch having a softening point of 280° C. was used as a starting material. The molten pitch was drawn using a spinning nozzle having a slit with a width of 3 mm and 1,500 spinning holes with a diameter of 0.2 mm aligned in the slit with the width of 3 mm, while gushing hot air from the slit, to prepare pitch fibers. The viscosity of the spinning pitch in this procedure was 12 poise.

The pitch fibers obtained by the spinning were collected on a stainless steel wire mesh belt of 20 in mesh with suctioning the pitch fibers from the back side of the belt.

A mat of the collected pitch fibers was heated from room temperature up to 300° C. in air at an average heating rate of 6° C./min to infusibilize the pitch fibers.

The infusibilized mesophase pitch fibers thus obtained were then carbonized at 650° C. to obtain carbon fibers.

The amount of the metallic components contained in the carbon fibers, as measured by plasma emission analysis, was 13/1,000,000 in terms of a ratio by weight.

The amount of the metallic components contained in the starting pitch, as measured by plasma emission analysis, was 11/1,000,000 in terms of a ratio by weight.

Then, the carbon fibers were milled by means of a milling machine of cross-flow type to obtain milled carbon fibers.

The particle size of the milled carbon fibers was measured by a particle size distribution measuring device of laser diffraction type. As a result, the mean particle diameter of the milled carbon fibers was 20 $\mu$m.

The amount of the metallic components contained in the milled carbon fibers was 40/1,000,000 in terms of a ratio by weight and it was extremely low. That is, it was confirmed that the blade of the milling machine was abraded in a small amount.

Subsequently, the milled carbon fibers were subjected obtain milled graphite fibers.

The milled graphite fibers were sifted through a sieve having a mean opening diameter of 105 $\mu$m to obtain 0.2% by weight of particulate substances on the sieve. From this fact, it was confirmed that the particulate substances were produced in an extremely small amount. Then, the particulate substances were observed by a scanning electron microscopy (SEM). As a result, agglomerates of the milled fibers were hardly found, and it was confirmed that the particulate substances were mainly made up of coke-like expanded particles.

The amount of the metallic components contained in the milled graphite fibers was 19/1,000,000 in terms of a ratio by weight.

Example 2

Infusibilized mesophase pitch fibers prepared in the same manner as in Example 1 were carbonized at 650° C. to obtain carbon fibers. The carbon fibers were milled by a milling machine of cross-flow type having been improved in abrasion resistance by nitriding treatment of its cast iron stationary blade, to obtain milled carbon fibers. The particle size of the milled carbon fibers was measured by a particle size distribution measuring device of laser diffraction type. As a result, the mean particle diameter of the milled carbon fibers was 20 μm.

The amount of the metallic components contained in the milled carbon fibers, as measured by plasma emission analysis, was 32/1,000,000 in terms of a ratio by weight and it was extremely low. That is, it was confirmed that the blade of the milling machine was abraded in a small amount.

Then, the milled carbon fibers were subjected to high-temperature graphitizing at 2,800° C. to obtain milled graphite fibers.

The milled graphite fibers were sifted through a sieve having a mean opening diameter of 105 μm to obtain 0.05% by weight of particulate substances on the sieve. Similarly to Example 1, it was confirmed that the particulate substances were produced in an extremely small amount. Then, the particulate substances were observed by SEM. As a result, it was confirmed that the particulate substances were mainly made up of coke-like expanded particles, similarly to Example 1.

The amount of the metallic component contained in the milled graphite fibers was 18/1,000,000 in terms of a ratio by weight.

Example 3

Infusibilized mesophase pitch fibers prepared in the same manner as in Example 1 were carbonized at 1,100° C. to obtain carbon fibers. The carbon fibers were milled by a milling machine of cross-flow type having been improved in abrasion resistance by nitriding treatment of its cast iron stationary blade and prevented from contamination with metallic oxide or the like by impregnation lining of the inside thereof and every powder transport line, to obtain milled carbon fibers. The particle size of the milled carbon fibers was measured by a particle size distribution measuring device of laser diffraction type. As a result, the mean particle diameter of the milled carbon fibers was 20 μm.

The amount of the metallic components contained in the milled carbon fibers, as measured by plasma emission analysis, was 52/1,000,000 in terms of a ratio by weight and it was extremely low. That is, it was confirmed that the abrasion resistance of the blade of the milling machine was improved thereby to reduce contamination with the metallic components.

Then, the milled carbon fibers were subjected to high-temperature graphitizing at 2,800° C. to obtain milled graphite fibers.

Figure 2:
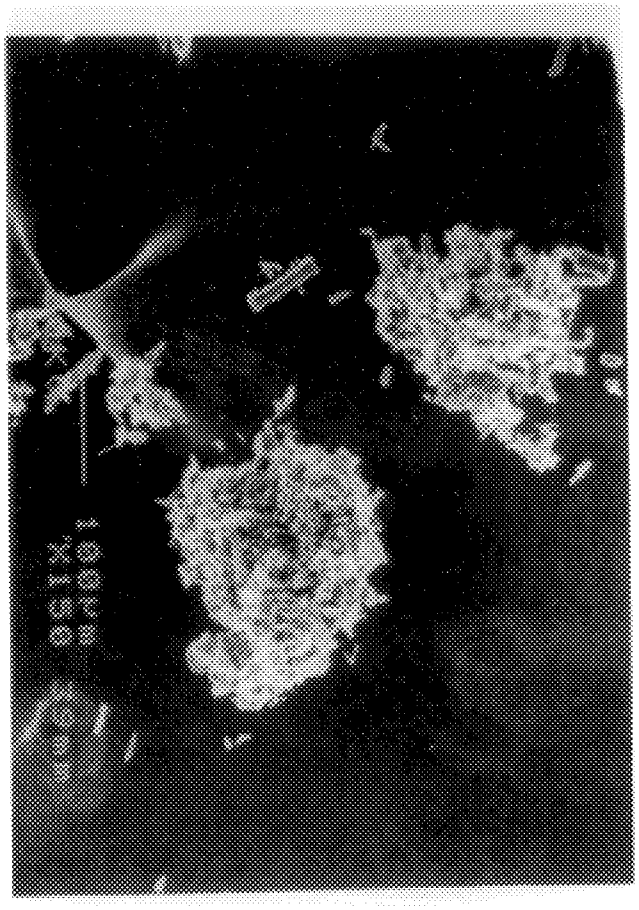
FIG. 2 is a 150-magnification scanning electron micrograph of particulate substances separated by sifting milled graphite fibers obtained in Comparative Example 1.

The milled graphite fibers were sifted through a sieve having a mean opening diameter of 105 μm to obtain 0.3% by weight of particulate substances on the sieve. Similarly to Example 1, it was confirmed that the particulate substances were produced in an extremely small amount. Then, the particulate substances were observed by SEM. As a result, such particulate substances as shown in FIGS. 1 and 2 were mainly found, and any coke-like expanded particle was not found.

The amount of the metallic components contained in the milled graphite fibers was 46/1,000,000 in terms of a ratio by weight.

Comparative Example 1

Infusibilized mesophase pitch fibers prepared in the same manner as in Example 1 were carbonized at 950° C. to obtain carbon fibers.

The amount of the metallic components contained in the carbon fibers was 12/1,000,000 in terms of a ratio by weight.

The carbon fibers were milled by a milling machine of cross-flow type equipped with a cast iron stationary blade, to obtain milled carbon fibers. The particle size of the milled carbon fibers was measured by a particle size distribution measuring device of laser diffraction type. As a result, the mean particle diameter of the milled carbon fibers was 20 μm.

The amount of the metallic components contained in the milled carbon fibers increased and it was 1,445/1,000,000 in terms of a ratio by weight. That is, it was confirmed that the blade was violently abraded.

Then, the milled carbon fibers were subjected to high-temperature graphitizing at 2,800° C. to obtain milled graphite fibers. The milled graphite fibers were sifted through a sieve having a mean opening diameter of 105 μm to obtain 3.5% by weight of particulate substances on the sieve. That is, it was confirmed that production of the particulate substances increased.

The amount of the metallic components contained in the milled graphite fibers was 119/1,000,000 in terms of a ratio by weight. The amount of the metallic components contained in the particulate substances were 689/1,000,000 in terms of a ratio by weight.

Then, the particulate substances were observed by SEM. As a result, it was confirmed that the particulate substances consisted of milled fibers and spherical matters of various sizes which were presumed to be newly produced as shown in FIGS. 1 and 2.

Referencial Example 1

Easily-graphitizable pitch was spun in a conventional manner and then infusibilized at 300° C. to obtain infusibilized fibers.

The amount of the metallic components contained in the infusibilized fibers, as measured by plasma emission analysis, was 12/1,000,000 in terms of a ratio by weight.

The infusibilized fibers were milled by a milling machine of cross-flow type under the same conditions as in Example 1 to obtain milled fibers. The particle size of the milled fibers was measured by a particle size distribution measuring device of laser diffraction type. As a result, the mean particle diameter of the milled fibers was 10 μm, and it was confirmed that the fibers had been very finely milled.

Then, the milled fibers were observed by SEM. As a result, it was confirmed that the fibers had been milled until they lose their original fiber shapes.

Referential Example 2

Infusibilized mesophase pitch fibers prepared in the same manner as in Example 1 were carbonized at 1,350° C. to obtain carbon fibers. The carbon fibers were milled by a milling machine of cross-flow type having been improved in abrasion resistance by nitriding treatment of its cast iron stationary blade and prevented from contamination with metallic oxide or the like by impregnation lining of the inside thereof and every powder transport line, to obtain milled carbon fibers. The particle size of the milled carbon fibers was measured by a particle size distribution measuring device of laser diffraction type. As a result, the mean particle diameter of the milled carbon fibers was 18 μm.

Then, the milled carbon fibers were observed by SEM. As a result, it was confirmed that the milled carbon fibers which were cracked in the longitudinal direction and the milled carbon fibers which were broken in the longitudinal direction were present in the total amount of 42% in terms of a ratio by number.

Comparative Example 2

Infusibilized mesophase pitch fibers prepared in the same manner as in Example 1 were carbonized at 1,110° C. to obtain carbon fibers. The carbon fibers were milled by a milling machine of cross-flow type having been improved in abrasion resistance by nitriding treatment of its cast iron stationary blade and prevented from contamination with metallic oxide or the like by impregnation lining of the inside thereof and every powder transport line, to obtain milled carbon fibers. The particle size of the milled carbon fibers was measured by a particle size distribution measuring device of laser diffraction type. As a result, the mean particle diameter of the milled carbon fibers was 20 μm.

The amount of the metallic components contained in the milled carbon fibers, as measured by plasma emission analysis, was 105/1,000,000 in terms of a ratio by weight.

Then, the milled carbon fibers were subjected to high-temperature graphitizing at 2,800° C. to obtain milled graphite fibers. The milled graphite fibers were sifted through a sieve having a mean opening diameter of 105 μm to obtain 2.5% by weight of particulate substances on the sieve. Then, the particulate substances were observed by SEM. As a result, it was confirmed that the particulate substances consisted of the milled fibers and spherical matters of various sizes which were presumed to be newly produced.

The amount of the metallic components contained in the milled graphite fibers was 110/1,000,000 in terms of a ratio by weight.

What is claimed is:

1. A process for preparing milled graphite fibers, comprising the steps of:

milling carbon fibers obtained by carbonizing mesophase pitch fibers at 600° to 1,200° C. by treating said fibers with a milling apparatus in which said milling is performed by a nitride-treated milling part treated to improve abrasion resistance thereof by collision with the fibers; and graphatizing the milled carbon fibers at 2,500° C. or higher, said process further comprising controlling said milling and temperature of carbonization such that the metallic components contained in the milled carbon fibers before said graphatizing step present in addition to metallic components originally contained in the fibers themselves are limited to not more than 50/1,000,000, as measured by weight.

* * * * *